US009238164B2

(12) United States Patent
Perry, Jr.

(10) Patent No.: US 9,238,164 B2
(45) Date of Patent: Jan. 19, 2016

(54) GAME APPARATUS

(76) Inventor: Doyle Dean Perry, Jr., Clovis, CA (US)

( * ) Notice: Subject to any disclaimer, the term of this patent is extended or adjusted under 35 U.S.C. 154(b) by 1114 days.

(21) Appl. No.: 13/286,218

(22) Filed: Nov. 1, 2011

(65) Prior Publication Data

US 2013/0106057 A1 May 2, 2013

(51) Int. Cl.
*A63B 67/02* (2006.01)
*A63B 69/40* (2006.01)

(52) U.S. Cl.
CPC ..... *A63B 67/02* (2013.01); *A63B 69/407* (2013.01)

(58) Field of Classification Search
CPC ..... A63B 67/02; A63B 69/407; A63B 69/40; A63F 7/00; A63F 7/0005; A63F 7/06; A63F 7/0628; A63F 7/20; A63F 7/2409; A63F 7/2418; A63F 7/2472; A63F 7/2481; A63F 7/249
USPC ..... 273/317, 317.1, 317.2, 108.2, 129 R, 273/129 V, 129 W; 473/516; 124/16
See application file for complete search history.

(56) References Cited

U.S. PATENT DOCUMENTS 675,456 A * 6/1901 Voorhees ..... 273/108.2
872,371 A * 12/1907 Roberts et al. ..... 446/333
1,136,465 A * 4/1915 Clark, Jr. ..... 273/108.22
1,173,818 A * 2/1916 Lins ..... 273/317.2
1,429,656 A * 9/1922 Stonebridge ..... 273/108.2
1,493,934 A * 5/1924 Grau et al. ..... 273/317.2
2,114,777 A * 4/1938 Englerth ..... 273/317
2,147,705 A * 2/1939 Hunter ..... 473/436
2,793,037 A * 5/1957 Smith ..... 273/108.2
3,458,195 A * 7/1969 Neubeck ..... 273/108.22
3,469,846 A * 9/1969 Lippert ..... 473/185
3,503,613 A * 3/1970 Caya ..... 273/108.22
3,598,411 A * 8/1971 Lippert ..... 273/129 R
3,598,412 A * 8/1971 Lippert ..... 273/129 R
3,598,413 A * 8/1971 Lippert ..... 273/129 R
3,612,027 A * 10/1971 Makino ..... 124/16
3,944,229 A 3/1976 Feeney
3,960,379 A 6/1976 Maloney et al.
3,985,358 A 10/1976 Hamano
3,989,249 A 11/1976 Breslow
4,042,246 A 8/1977 Strandgard
4,050,439 A 9/1977 Rudy
4,074,905 A 2/1978 High
4,086,901 A 5/1978 Clement
4,093,233 A 6/1978 Barbarow
4,098,507 A 7/1978 Hudon
4,108,442 A 8/1978 Bynam
4,126,314 A 11/1978 Martin
4,127,273 A 11/1978 Bonvetti, III
4,168,695 A 9/1979 Haller et al.
4,169,453 A 10/1979 Hunsicker
4,176,845 A 12/1979 Lancaster
4,209,003 A 6/1980 Sainsbury (Continued)

*Primary Examiner* — Raleigh W Chiu
(74) *Attorney, Agent, or Firm* — Marcus N. DiBuduo

(57) ABSTRACT

Apparatuses for playing miniaturized recreational games can include a base, a coupler, and a projectile launcher. The coupler can be rotatably positionable and engaged with the base. The projectile launcher can include a deformable elongate rod which can be engaged with the coupler. The apparatus can also include a second coupler and a projectile putter. The second coupler can be rotatably engaged with the base assembly. The projectile putter can include a rigid elongate rod which can be engaged with the second coupler. In use, the projectile launcher can aerially discharge a playing piece such as a ball, and the projectile putter can impart motion of the playing piece resting on a playing surface.

31 Claims, 10 Drawing Sheets

(56) References Cited

U.S. PATENT DOCUMENTS

| | | | | |
|---|---|---|---|---|
| 4,254,755 | A | 3/1981 | Morgan et al. | |
| 4,269,162 | A | 5/1981 | Abraham et al. | |
| 4,277,065 | A | 7/1981 | White | |
| 4,282,848 | A | 8/1981 | Kulesza et al. | |
| 4,331,334 | A | 5/1982 | Clemmer | |
| 4,345,577 | A | 8/1982 | Andersson | |
| 4,364,569 | A | 12/1982 | Duwell et al. | |
| 4,380,338 | A | 4/1983 | Lacy | |
| 4,391,264 | A | 7/1983 | Abraham et al. | |
| 4,423,877 | A | 1/1984 | Cook | |
| 4,436,077 | A | 3/1984 | Smith | |
| 4,511,142 | A * | 4/1985 | Pote, Jr. | 273/317.2 |
| 4,544,162 | A | 10/1985 | Ferris et al. | |
| 4,548,407 | A | 10/1985 | Sato | |
| 4,569,526 | A | 2/1986 | Hamilton | |
| 4,570,938 | A | 2/1986 | Ferris et al. | |
| 4,666,160 | A | 5/1987 | Hamilton | |
| 4,699,378 | A | 10/1987 | Sung | |
| 4,743,026 | A | 5/1988 | Eady | |
| 4,759,548 | A | 7/1988 | Chaban | |
| 4,809,985 | A | 3/1989 | Trimble | |
| 4,844,045 | A | 7/1989 | Powell et al. | |
| 4,860,717 | A | 8/1989 | Powell et al. | |
| 4,907,802 | A | 3/1990 | Gatin | |
| 4,911,136 | A | 3/1990 | Brown | |
| 5,000,460 | A | 3/1991 | Barbiaux et al. | |
| 5,112,057 | A | 5/1992 | Popovic | |
| 5,121,735 | A | 6/1992 | Hancock | |
| 5,129,650 | A | 7/1992 | Hayman | |
| 5,174,565 | A | 12/1992 | Komori | |
| 5,181,501 | A | 1/1993 | Lien | |
| 5,273,290 | A | 12/1993 | Cole et al. | |
| 5,358,248 | A | 10/1994 | Jankosky | |
| 5,398,665 | A | 3/1995 | Carlson | |
| 5,415,150 | A | 5/1995 | Dallas | |
| 5,417,420 | A * | 5/1995 | Berg | 273/108.2 |
| 5,431,145 | A | 7/1995 | Strait et al. | |
| 5,439,212 | A | 8/1995 | Hart | |
| 5,449,171 | A * | 9/1995 | Makhoulian | 273/108.22 |
| 5,470,077 | A | 11/1995 | Brewster et al. | |
| 5,518,248 | A | 5/1996 | Lightfoot | |
| 5,551,412 | A | 9/1996 | Warnke | |
| 5,566,934 | A | 10/1996 | Black et al. | |
| 5,619,977 | A | 4/1997 | Gatin | |
| 5,636,844 | A | 6/1997 | de Buys | |
| 5,657,984 | A | 8/1997 | Leo | |
| 5,660,386 | A | 8/1997 | Krieger | |
| 5,692,751 | A | 12/1997 | Morrissey | |
| 5,720,482 | A | 2/1998 | Boudrias | |
| 5,722,659 | A | 3/1998 | Gluth | |
| 5,800,288 | A | 9/1998 | Mims | |
| 5,884,915 | A | 3/1999 | Koziol | |
| 5,908,192 | A | 6/1999 | West | |
| 5,911,214 | A | 6/1999 | Andrews | |
| 5,924,693 | A | 7/1999 | Beaumier et al. | |
| 5,975,527 | A | 11/1999 | Winchester | |
| 6,042,117 | A | 3/2000 | O'Brien | |
| 6,047,967 | A | 4/2000 | Murphy et al. | |
| 6,105,963 | A | 8/2000 | Dontfraid | |
| 6,129,076 | A | 10/2000 | Powell et al. | |
| 6,155,569 | A | 12/2000 | Horiuchi et al. | |
| 6,171,169 | B1 * | 1/2001 | Saunders | 446/308 |
| 6,386,539 | B1 | 5/2002 | Deskovick | |
| 6,419,229 | B1 | 7/2002 | Whittington et al. | |
| 6,457,713 | B1 | 10/2002 | Oppenheimer et al. | |
| 6,546,923 | B2 | 4/2003 | Erickson | |
| 6,595,863 | B2 | 7/2003 | Chamberlain et al. | |
| 6,644,292 | B1 | 11/2003 | Ganson | |
| 6,715,762 | B2 | 4/2004 | Simmons | |
| 6,749,528 | B2 | 6/2004 | Wengert | |
| 6,843,241 | B1 | 1/2005 | Newcomer | |
| 6,884,188 | B2 | 4/2005 | Cherry | |
| 7,063,623 | B2 | 6/2006 | Wengert | |
| 7,150,689 | B2 | 12/2006 | Balingit | |
| 7,207,564 | B2 | 4/2007 | Bedford et al. | |
| 7,240,903 | B2 | 7/2007 | Jacobs | |
| 7,287,752 | B2 | 10/2007 | Barry | |
| 7,364,164 | B2 | 4/2008 | Anasis et al. | |
| 7,415,976 | B1 | 8/2008 | Powell | |
| 7,448,628 | B2 | 11/2008 | Pedersen | |
| 7,458,907 | B2 | 12/2008 | Wang | |
| 7,540,500 | B2 | 6/2009 | Kiraly | |
| 7,731,196 | B2 | 6/2010 | Scoccia | |
| 7,766,337 | B2 | 8/2010 | Constantine et al. | |
| 7,827,977 | B2 | 11/2010 | Saunders | |
| 7,845,644 | B2 | 12/2010 | Constantine et al. | |
| 7,857,317 | B2 | 12/2010 | Noda et al. | |
| 2013/0106057 | A1 * | 5/2013 | Perry, Jr. | 273/317 |

* cited by examiner

GAME APPARATUS

BACKGROUND OF THE INVENTION

1. Field of the Invention

The present invention concerns miniaturized recreational games. More specifically, some embodiments of the present invention pertain to apparatuses and methods for playing miniaturized golf where the path of a ball can be modified by changing numerous parameters.

2. Background

Conventional golf is played using a plurality of clubs, each having differing shaft lengths, head weights, and face angles. Along with the force applied by the player's swing and the grip position, the particular club selected by the player significantly affects the trajectory, path, and/or travel distance of the ball upon impact. Repeated practice enables a player to move the ball to a desired position by selecting one of a plurality of clubs and then hitting the ball with a certain amount of force, and thus improving their skill.

However, conventional golf requires a large course that sometimes spans tens of acres. Upkeep of these courses requires significant time and money, which directly affect the cost of the fees that one must pay to play. Additionally, conventional golf can usually not be played in inclement weather.

Conventional miniaturized golf requires a much smaller course and typically includes reduced maintenance features, such as synthetic grass. This allows miniaturized golf facilities to be not only cheaper to play, but centrally located in urban areas, sometimes inside of buildings. However, conventional miniaturized golf heretofore has been limited to putting applications where the ball is intended to at all times remain on the ground. Miniaturized golf also conventionally does utilize varying clubs from which a player can select. As a result, many do not view conventional miniaturized golf as a suitable alternative to conventional golf since it lacks the ability for players to improve their skill.

It is therefore desirable for apparatuses and methods for playing games which include the mechanics and skill of conventional golf but and the convenience of miniaturized golf.

SUMMARY OF THE INVENTION

Embodiments of the present invention relate to novel apparatuses and methods of playing miniaturized recreational games. More specifically, disclosed are apparatuses that can include adjustable features for launching a projectile along desired trajectories and/or paths.

In some aspects, the invention concerns a game apparatus that can include: a base having an index with a central bore and a plurality of slots around the bore; a coupler having an protrusion and at least one tab around the protrusion; a deformable elongate rod engaged to the coupler; and a basket on a distal end of the elongate rod. In some preferred embodiments, the coupler can be rotatably engaged to the index. In some preferred embodiments, the elongate rod can be a spring, such as an expansion spring or a compression spring.

In some embodiments, the bore of the index can axially receive at least a portion of the coupler protrusion. In some implementations, the index slots and coupler tabs can be on opposing side faces of the index and coupler, respectively. In some other implementations, the slots of the index can be on an inner surface of the bore and the coupler tabs can be on an outer lateral surface of the coupler protrusion.

In some implementations, the coupler can include a recess receiving the elongate rod. A clamp may secure the elongate rod in the coupler recess, and may include a plate, a nut, and/or a screw.

In some embodiments, the coupler can be engaged to the index by a spring detent. In some implementations, the spring detent can include a compression spring and a compression plate. The compression plate may be engaged to a distal end of the coupler protrusion. The compression spring may circumscribe at least a portion of the coupler protrusion. In some implementations, the compression spring can be in compression between the compression plate and an inner lip of the index bore.

In some further embodiments, the apparatus can include: a second coupler rotatably engaged to the base; a rigid second elongate rod engaged to the second coupler; and a head on a distal end of the second elongate rod.

In some implementations, the second coupler can include a recess receiving the second elongate rod. The second coupler slot may include at least one lock securing the second elongate rod in the second coupler recess.

In some implementations, the apparatus can include a cap and a shoulder screw. The cap can engaged to the base and the shoulder screw can rotatably engage the second coupler to the cap.

In some embodiments, at least one foot can be hingedly engaged with the base. The foot may be engaged with the base by a snap-fit connection.

In some aspects, the invention concerns a game having a game piece that can include: a base having an index with a plurality of slots; a first coupler rotatably engaged to the index, the first coupler having at least one tab insertable into one of the plurality of slots of the index; and a second coupler rotatably engaged to the base. In some implementations, the first and/or the second coupler may have a recess. In some implementations, at least one foot can be hingedly engaged to the base.

In some embodiments, the game can include at least one deformable elongate rod insertable in the recess of the first coupler. In some embodiments, the deformable elongate rod can be a spring, such as an expansion spring or a compression spring. The deformable elongate rod may include a basket on a distal end thereof. In some embodiments, the game can include two deformable elongate rods having different lengths, tensions, force constants, and/or basket geometries.

In some embodiments, the game can include at least one rigid elongate rod insertable in the recess of the second coupler. The rigid elongate rod may include a head on a distal end thereof. In some embodiments, the game can include two rigid elongate rods having different lengths, geometries, and/or head weights.

In some embodiments, the game can include a playing field having one of the group consisting of a target hole, greenery, hills, water features, and combinations thereof.

In some aspects, the invention concerns a method of playing a game that has a projectile and a game piece that has a base with an index, a coupler rotatably engaged to the index, and at least one deformable elongate rod with a basket on a distal end thereof. In preferred embodiments, the method can include the steps of: engaging the deformable elongate rod to the coupler; rotating the coupler to a first position relative to the index; placing the projectile in the basket; deforming the deformable elongate rod; and releasing the deformable elongate rod to discharge the projectile from the basket.

The game piece may further include a plurality of deformable elongate rods each having baskets on distal ends thereof. In some embodiments, the method can further include the steps of: disengaging a first deformable elongate rod from the coupler; and engaging a second deformable elongate rod to the coupler.

The game piece may further include a second coupler rotatably engaged to the base and at least one rigid elongate rod with a head on a distal end thereof. In some embodiments, the method can further include the steps of: engaging the rigid elongate rod to the second coupler; placing the game piece near the projectile; angularly displacing the rigid elongate rod relative to the base; and releasing the rigid elongate rod to cause the head of the rigid elongate rod to impart a force on the projectile.

The game piece may further include a plurality of rigid elongate rods each having heads on distal ends thereof. In some embodiments, the method can further include the steps of: disengaging a first rigid elongate rod from the second coupler; and engaging a second rigid elongate rod to the coupler.

It is to be appreciated that apparatuses and methods in accordance with embodiments of the present invention enable miniaturized recreational entertainment that most closely parallels mechanics, skill development, and gamesmanship of their counterpart conventional games. In addition, the ability to make numerous adjustments to various parameters enables recreational entertainment that varies each time played.

These and other objects, advantages and features of the invention, together with the organization and manner of operation thereof, will become apparent from the following detailed description when taken in conjunction with the accompanying drawings, wherein like elements have like numerals throughout the several drawings described herein.

DETAILED DESCRIPTION OF THE PREFERRED EMBODIMENTS

The invention, in its various aspects, will be explained in greater detail below. While the invention will be described in conjunction with several exemplary embodiments, the exemplary embodiments themselves do not limit the scope of the invention. Similarly, the exemplary embodiments as illustrated in the accompanying drawings, where like elements have like numerals, do not limit the scope of the exemplary embodiments and/or invention. Rather the invention, as defined by the claims, may cover alternatives, modifications, and/or equivalents of the exemplary embodiments.

It is to be appreciated that although the invention is described in conjunction with apparatuses and methods for playing miniaturized golf games, several embodiments of the present invention also contemplate other applications. For example, and without limitation, some aspects of the invention may be practiced to play miniaturized basketball, baseball, or other games.

Figure 1:
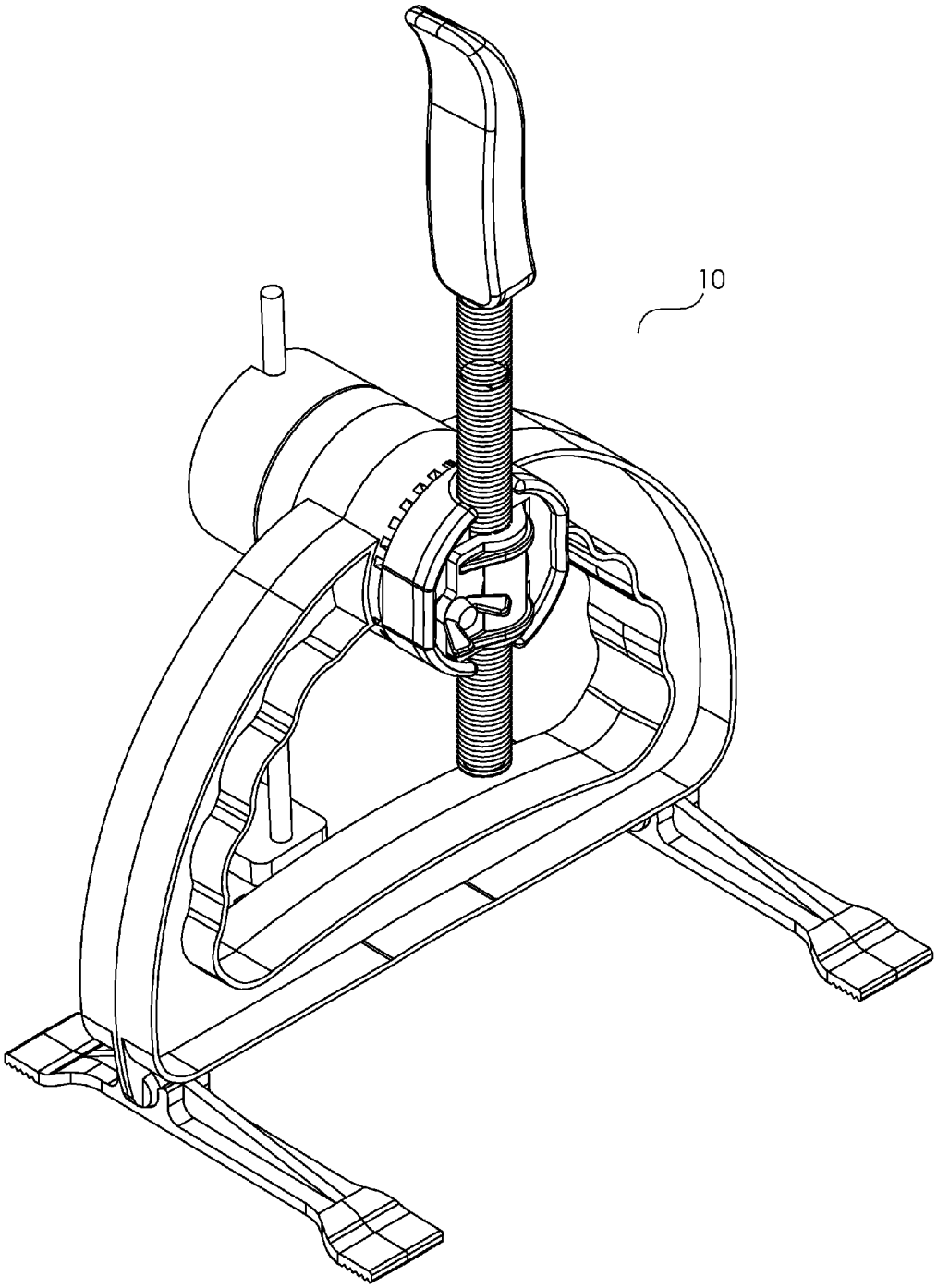
FIG. 1 is a diagram illustrating an exemplary game apparatus in accordance with some embodiments of the present invention.
Figure 2:
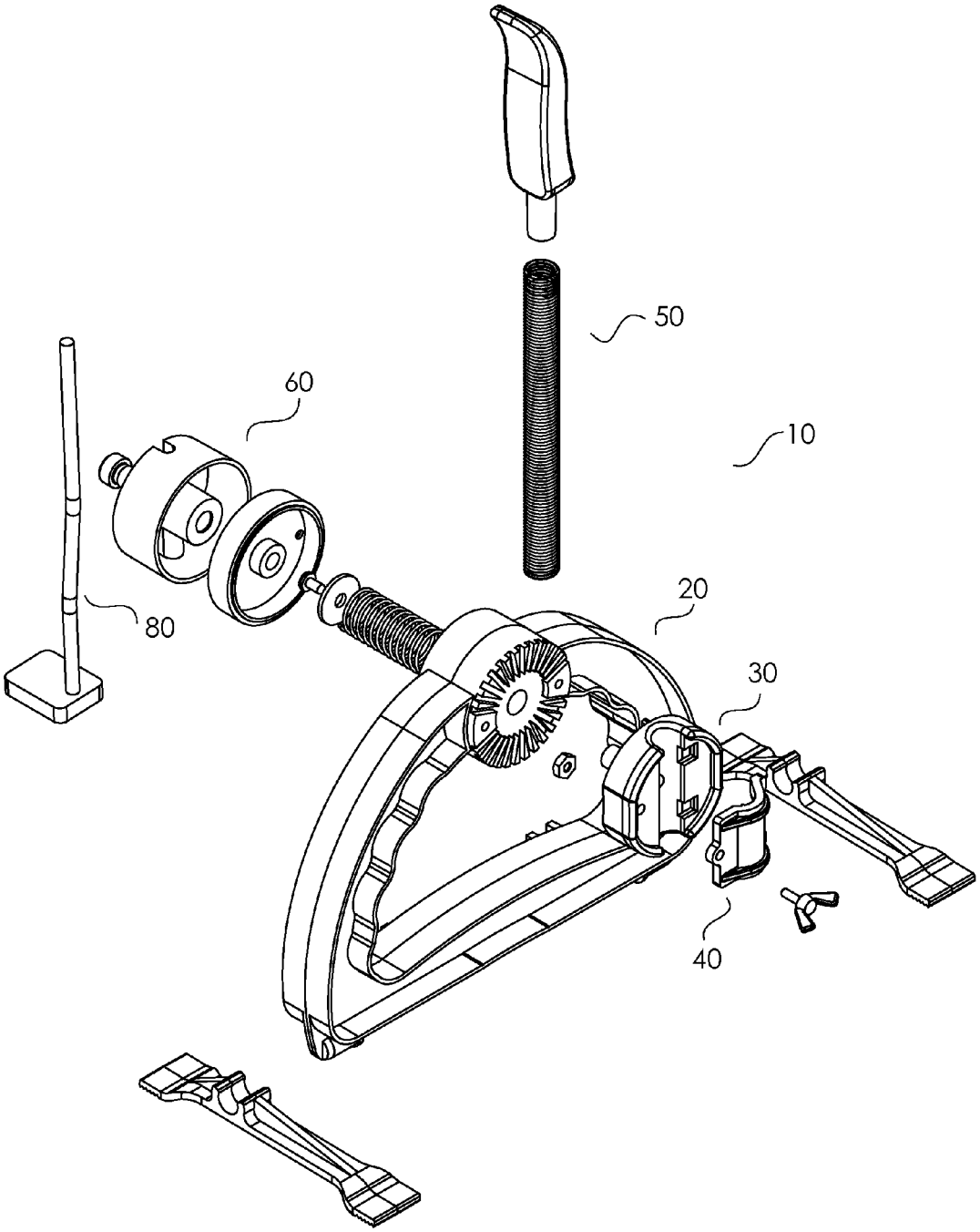
FIG. 2 is an exploded perspective diagram illustrating the exemplary game apparatus of FIG. 1.
Figure 3:
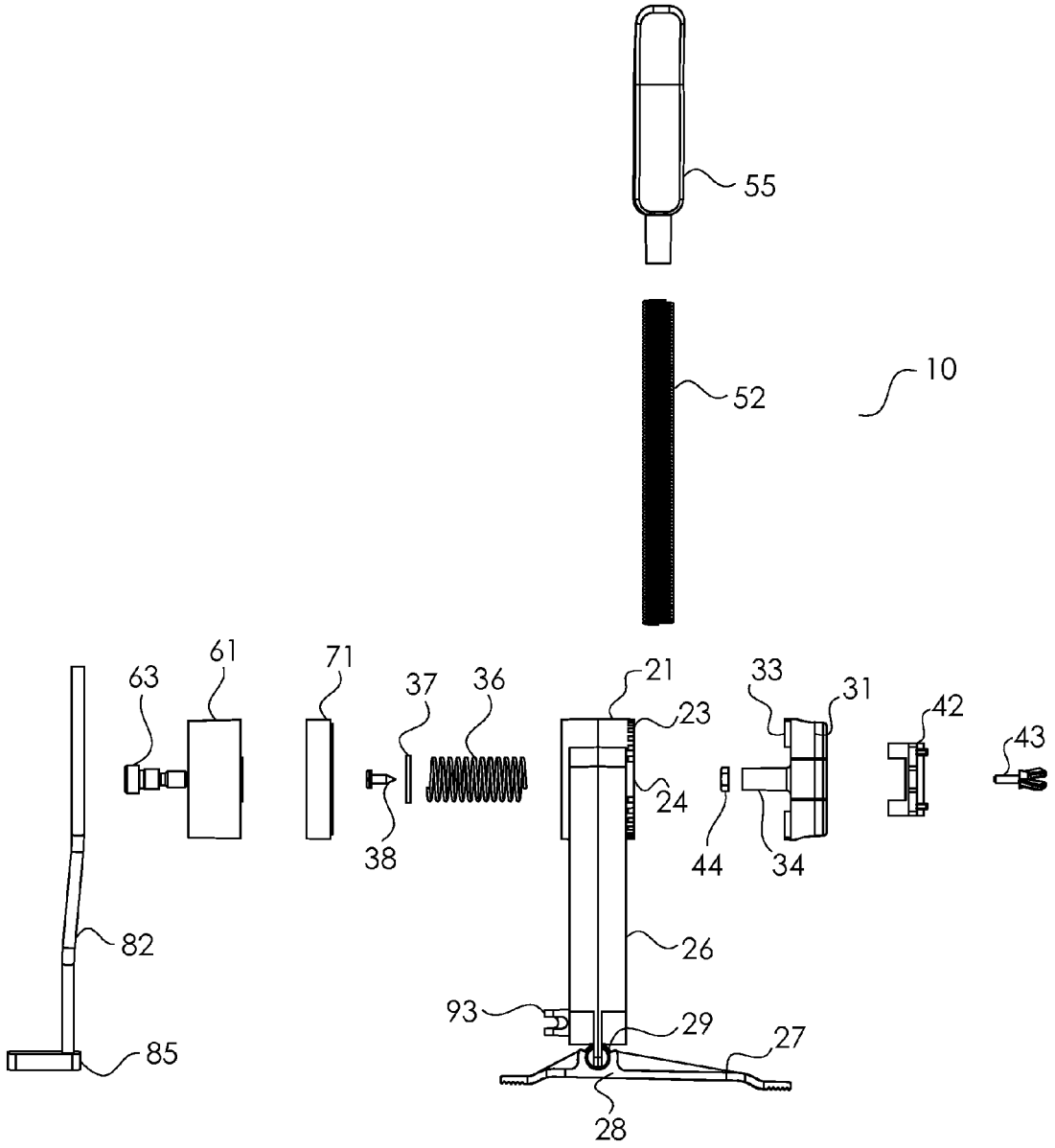
FIG. 3 is an exploded rear view diagram illustrating the exemplary game apparatus of FIG. 1.

Referring to the figures generally, and specifically to the illustrations of FIGS. 1-2, in some advantageous embodiments, game apparatus 10 can include base assembly 20, coupler assembly 30, and projectile launching assembly 50. As discussed more fully herein, projectile launching assembly 50 can include a deformable elongate rod, which can be engaged with coupler assembly 30 and secured therein by clamp assembly 40. In some advantageous embodiments, coupler assembly 30 can be rotatably positionable and engaged with a portion of base assembly 20. It can be appreciated that, in use, a bending force may be placed on a distal end of projectile launching assembly 50, and when such force is thereafter released, an object initially placed in a basket on the distal of projectile launching assembly 50 may discharged therefrom.

In some advantageous embodiments, game apparatus 10 can also include coupler assembly 60 and projectile putting assembly 80. As discussed more fully herein, projectile putting assembly 80 can include a rigid elongate rod, which can be engaged with coupler assembly 60. In some advantageous embodiments, coupler assembly 60 can be engaged to and rotatable with a portion of base assembly 20. In use, projectile putting assembly 80 may be angularly displaced, and when released, kinetic force may be imparted on an object that is initially placed near a head of projectile putting assembly 80.

Exemplary Game Apparatuses

Figure 6:
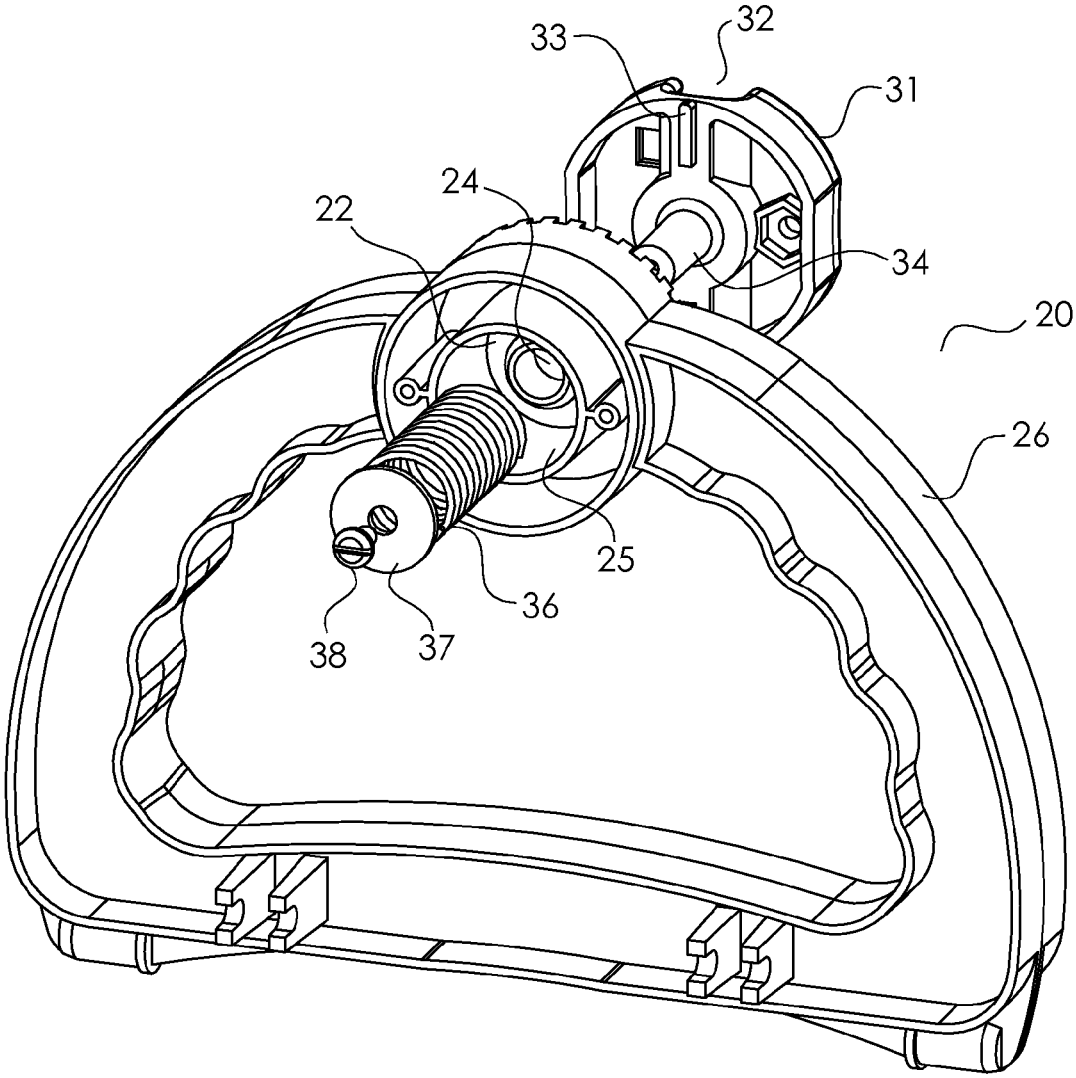
FIG. 6 is another exploded perspective diagram illustrating the exemplary coupler of FIG. 4.
Figure 7:
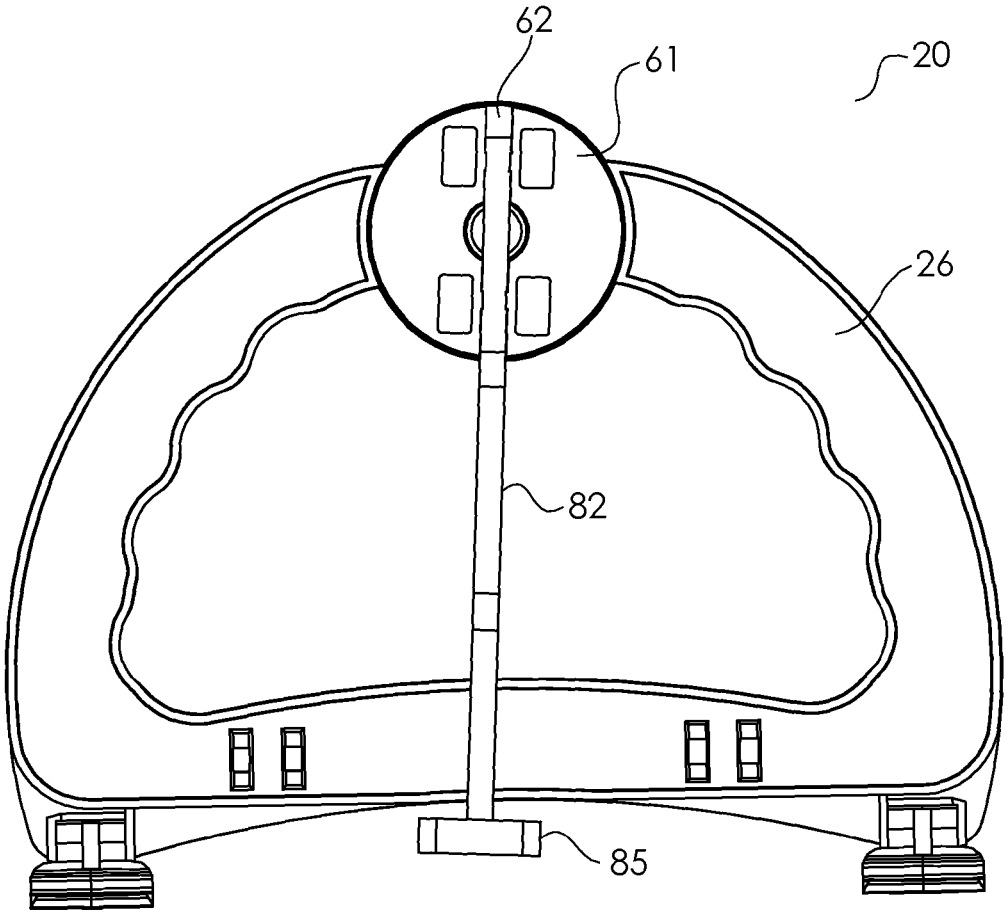
FIG. 7 is a side view diagram illustrating another exemplary coupler in accordance with some embodiments of the present invention.

In some advantageous embodiments of the invention, a game apparatus can include a base having and index with a central bore and a plurality of slots around the bore. Referring to the exemplary illustrations of FIGS. 3-6, base 20 of game apparatus 10 can include index 21. In some implementations, and without limitation, index 21 may be unitarily formed in base body 26. However index 21 may be a separable element and attached to, or engaged with, base body 26. In some embodiments, index 21 can include central bore 24 defining an opening, hole, cavity, recess and the like in index 21. In some implementations, bore 24 may extend entirely through index 21. It is to be appreciated however that bore 24 may extend only partially through index 21. As illustrated in FIG. 6, in some embodiments bore 24 can include radial inner surface 25. In some embodiments, index 21 can include inner lip 22. In some implementations, lip 22 may extend entirely around bore 21. It is to be appreciated however that lip 22 may extend only partially around bore 21. In some implementations, lip 22 may have an annular ring shape. However it is to be appreciated that lip 22 may have other shapes in accordance with some embodiments of the present invention.

In some embodiments, index 21 can include a plurality of slots 23 around bore 24. In some implementations, slots 23 may be on a side face of index 21. For example, and without limitation, slots 23 may extend radially outward from bore 24 on side face of index 21. In some other implementations, the plurality of slots may be on inner surface 25 of bore 24. For example, and without limitation, the plurality of slots may extend axially along inner surface 25 of bore 24. In some other implementations, the plurality of slots may be on lip 22. In some implementations, one or all of the plurality of slots can extend along the entire side face of index 21, inner surface 25 of bore 24, and/or lip 22. However, it is to be appreciated that one or more of the plurality of slots can only partial extend along such surfaces. It is also to be appreciated that one or more slots can be provided in one or more of a side face of index 21, inner surface 25 of bore 24, and lip 22 in accordance with some embodiments of the present invention. For example, and without limitation, slots can be provided in both side face of index 21 and lip 22. In some implementations, slots 23 have a uniform pitch around bore 24. However, it is to be appreciated that slots 23 may be non-uniformly spaced around bore 24.

In some advantageous embodiments of the invention, the game apparatus can include a coupler having a protrusion and at least one tab around the protrusion. Referring to the exemplary illustrations of FIGS. 3-6, in some embodiments, coupler 31 can include protrusion 34 and at least one tab 33. In some implementations, protrusion 34 can be about cylindrical and have dimensions corresponding to bore 24 and/or inner lip 22. However, it is to be appreciated that the protrusion can have other shapes in accordance with some embodiments of the present invention. In some implementations, tab 33 can be on a side face of coupler 31. For example, and without limitation, tab 33 may extend radially outward from protrusion 34 along a side face of coupler 31. However in some other implementations, at least one tab may be on an outer lateral surface of protrusion 34 of coupler 31. It is to be appreciated that one or more tabs can be provided on a side face of coupler 31 and the outer lateral surface of protrusion 34 of coupler 31. In some implementations, one or more of the tabs can extend along the entire side face of coupler 31 and/or outer lateral surface of protrusion 34. However, it is to be appreciated that one or more of the tabs can only partial extend along such surfaces.

It is to be appreciated that, in some embodiments, the protrusion and the tab of the coupler may cooperate with the bore and the slots of the index, respectively. For example, and without limitation, the geometry of protrusion 34 of coupler 31 may be such that it can be inserted into bore 24 of index 21. Similarly, and without limitation, the geometry of tab 33 of coupler 31 may be such that can be inserted into one of the plurality of slots 23. It is also to be appreciated that some apparatuses in accordance with some embodiments of the present invention may have different configurations of the bore, the slots, the protrusion, and/or the index. For example, and without limitation, the protrusion and tab of the coupler may form a gear-like structure and the bore and slots of the index may form a complementary gear-like structure.

In some advantageous embodiments of the invention, the coupler can be rotatably engaged to the index. For example, and without limitation, protrusion 34 of coupler 31 may cooperate with bore 24 of index 21 to provide relative rotation around a central and collinear axis of bore 24 and protrusion 34. It is further to be appreciated that, while the coupler is rotatable relative to the index, cooperation of the tab of the coupler and the slots of the index may restrict rotation of the coupler relative to the index. For example, and without limitation, when tab 33 is not positioned in one of slots 23, protrusion 34 positioned in bore 24 enable rotational movement of coupler 31 relative to index 21. However, when tab 33 is positioned in one of slots 23, rotational movement of coupler 31 relative to index 21 is restricted.

In some advantageous embodiments of the invention, the apparatus can include a spring detent to impart a force sufficient to hold the coupler in a temporarily fixed position relative to the base assembly. In some embodiments, and without limitation, the spring detent can include compression spring 36 and compression plate 37. In some implementations, compression spring 36 may circumscribe and be positioned around at least a portion of protrusion 34 of coupler 31. In some implementations, compression plate 37 may have a diameter greater than the diameter of the distal end of protrusion 34 and engaged thereto by screw 38 to prevent removal of compression spring 36 from the distal end of protrusion 34. It is to be appreciated that other configurations are contemplated by some embodiments of the present invention. For example, and without limitation, the functionality of the compression plate and screw may be replaced by an enlarged distal end of the protrusion of the coupler. In some other examples, a spring loaded collar may be provided on the distal end of the protrusion.

In some embodiments, compression spring 36 may be in compression between compression plate 37 and inner lip 22. It is to be appreciated that compression spring 36 imparts a force between lip 22 and compression plate 37, and thus in the absence of an outward pulling force on coupler 31, coupler 31 is secured to index 21. In some embodiments, when coupler 31 is secured to index 21, cooperation of tabs 33 and slots 23 restrict rotational movement of coupler 31 relative to index 21. When a an outward pulling force on coupler 31 exceeds the force imparted by compression spring 36 between lip 22 and compression plate 37, coupler 31 is unsecured from, and can rotate relative to, index 21. As such, it can be appreciated that the spring detent and the cooperation of the coupler tabs and index slots create a locking mechanism to selectably prevent rotation of the coupler assembly relative to the base assembly.

It is further to be appreciated that the angular position of the coupler assembly relative to the base assembly can be adjusted by selectably inserting the tabs of the coupler assembly into the slots of the index. For example, and without limitation, each of the plurality of slots 23 correspond to a discrete angular position of the coupler assembly relative to the base assembly. In some embodiments, tabs 33 may be selectably inserted into slots 23 by rotation of coupler 31 and index 21.

In some advantageous embodiments of the present invention, the apparatus can include a deformable elongate rod that is engaged to the coupler. Referring now specifically to the illustration in FIG. 4, in some embodiments, elongate rod 52 may be engaged with coupler 31 of coupler assembly 30. It is to be appreciated that, although in some preferred embodiments elongate rod 52 may be attachable and detachable from coupler 31, in some other embodiments the elongate rod may be permanently attached to the coupler.

In some embodiments, elongate rod 52 may comprise a spring. In some implementation, elongate rod 52 may comprise an extension spring. In some other implementations, elongate rod 52 may comprise a compression spring. It is to be appreciated however that other deformable elongate rods are contemplated in accordance with some embodiments of the present invention. For example, and without limitation, the elongate rod may comprise a standard compression spring, a variable pitch compression, a barrel spring, an hourglass spring, or a conical spring.

It is further to be appreciated that in some embodiments, the deformable elongate rod may comprise other deformable shapes and/or materials. For example, and without limitation, the deformable elongate rod may be formed of natural or synthetic elastomer or polymer material such as rubber. It is further to be appreciated that elongate rod can have a cylindrical, squared, or rectangular shape, and can be solid, hollow, or helical, in accordance with some embodiments of the invention.

In some implementations, the entirety of the elongate rod is deformable. However in some other implementations, less than the entirety of the elongate rod is deformable. For example, and without limitation, the deformable elongate rod may comprise a rigid section and a deformable section. It is to be appreciated that, in some embodiments, deformation of elongate rod 52 between coupler 31 and head 55 creates a springing force which, when released, may impart kinetic energy to projectile 59. Thus, in preferred embodiments, at least a portion of said elongate rod 52 is deformable between head 55 and the point of engagement to coupler 31.

In some advantageous embodiments, a basket can be provided on a distal end of the elongate rod. For example, and without limitation, basket 55 can be engaged or unitarily formed on a distal end of elongate rod 52. In some implementations, basket 55 includes a curved inner surface such that, at rest, projectile 59 may be stationary therein. It is to be appreciated that in some embodiments, a springing force imparted on elongate rod 52 may impart kinetic energy to projectile 59 which may be ejected from basket 55. Accordingly, it can further be appreciated that the trajectory of projectile 59 may be a function of, among other things, the characteristics of the curved inner surface of basket 55.

In some embodiments, and referring to FIGS. 3-6, coupler 31 can include recess 32 for receiving elongate rod 52 therein. In some implementations, recess 32 may be formed in an outer side wall of coupler 31. In some implementations, recess 32 may extend the entire diameter of coupler 31. In some other implementations, recess 32 may extend less than the entire diameter of coupler 31. In some embodiments, the apparatus can include a clamp for securing the elongate rod in the coupler recess. For example, and without limitation, the clamp may include plate 42 for securing elongate rod 52 in recess 32. In some implementations, and without limitation, plate 42 can be secured by screw 43 and/or nut 44. However in other implementations, the plate can be in snap-fit connection with the coupler. In yet other implementations, the plate can be in slidable engagement with the coupler. For example, and without limitation, the plate can be slidably engaged with the side face of the coupler. It is to be appreciated that other connections between the plate and the coupler are contemplated in accordance with some embodiments of the present invention. It is also to be appreciated that, in accordance with some other embodiments of the invention, the recess may be formed entirely within the coupler. For example, and without limitation, a recess in the form of an elongate cavity may be provided in a top surface of the coupler.

It is to be appreciated that the elongate rod can be engaged to the coupler though other means in accordance with some embodiments of the present invention. For example, and without limitation, the elongate rod may be screwed into a threaded recess in the coupler. In other examples, the elongate rod may be magnetically attached to the coupler. In other examples, the elongate rod may snap into or onto the coupler.

It is to be appreciated that coupler 31 and elongate rod 52 enable aerial projection of the game projectile 59. In some advantageous embodiments, the game apparatus can include a second coupler and a second elongate rod enabling surficial projection of the game projectile. Referring now to the exemplary illustrations of FIGS. 3, 7-9, in some embodiments, the apparatus may include second coupler 61 rotatably engaged to base assembly 20. In some implementations, the second coupler may be directly engaged with the base. For example, and without limitation, the second coupler may be engaged to the base via a rotation pin secured in the base. However, in some other implementations, the second coupler may be indirectly engaged with the base.

Figure 8:
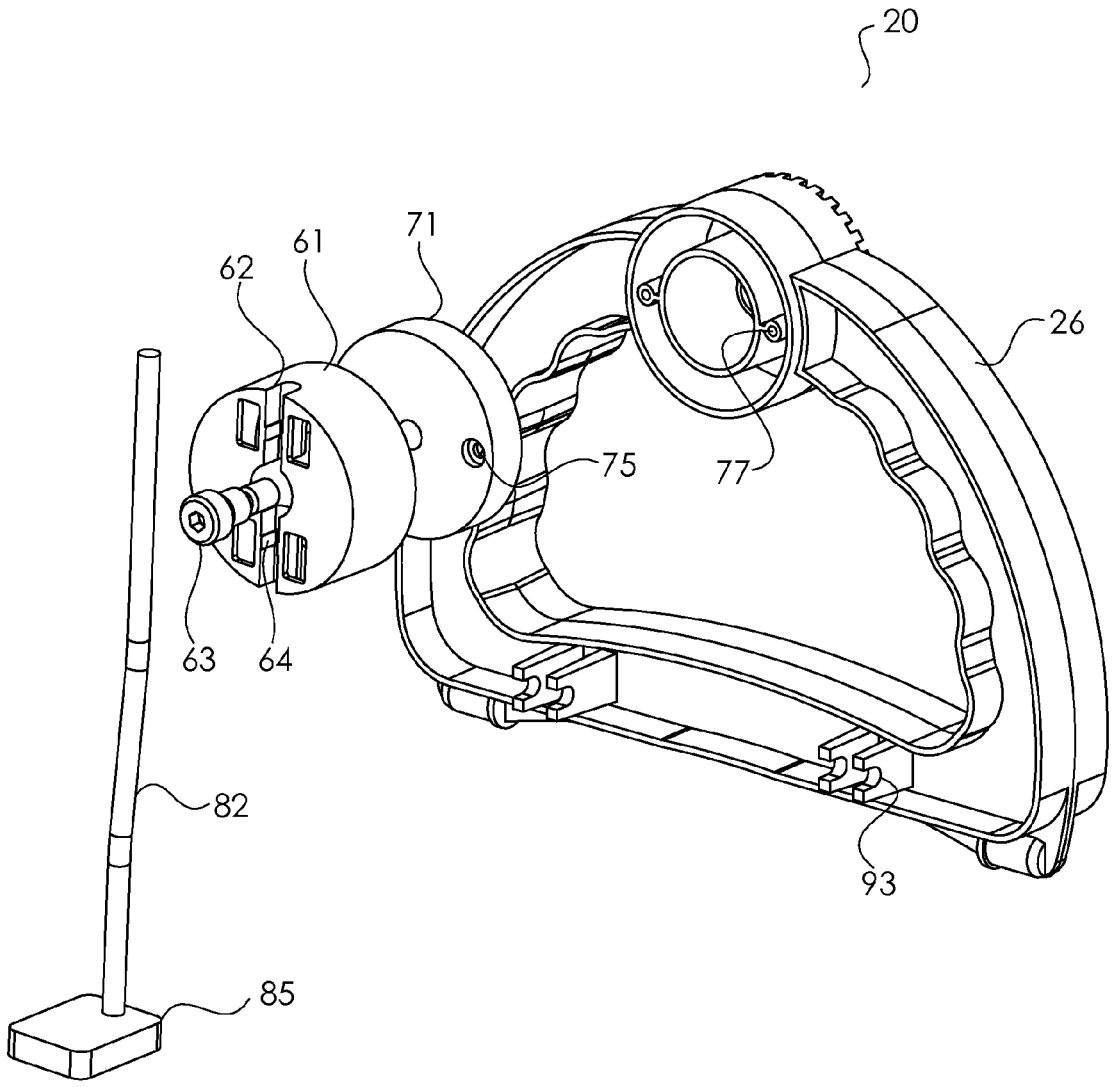
FIG. 8 is an exploded perspective diagram illustrating the exemplary coupler of FIG. 7.
Figure 9:
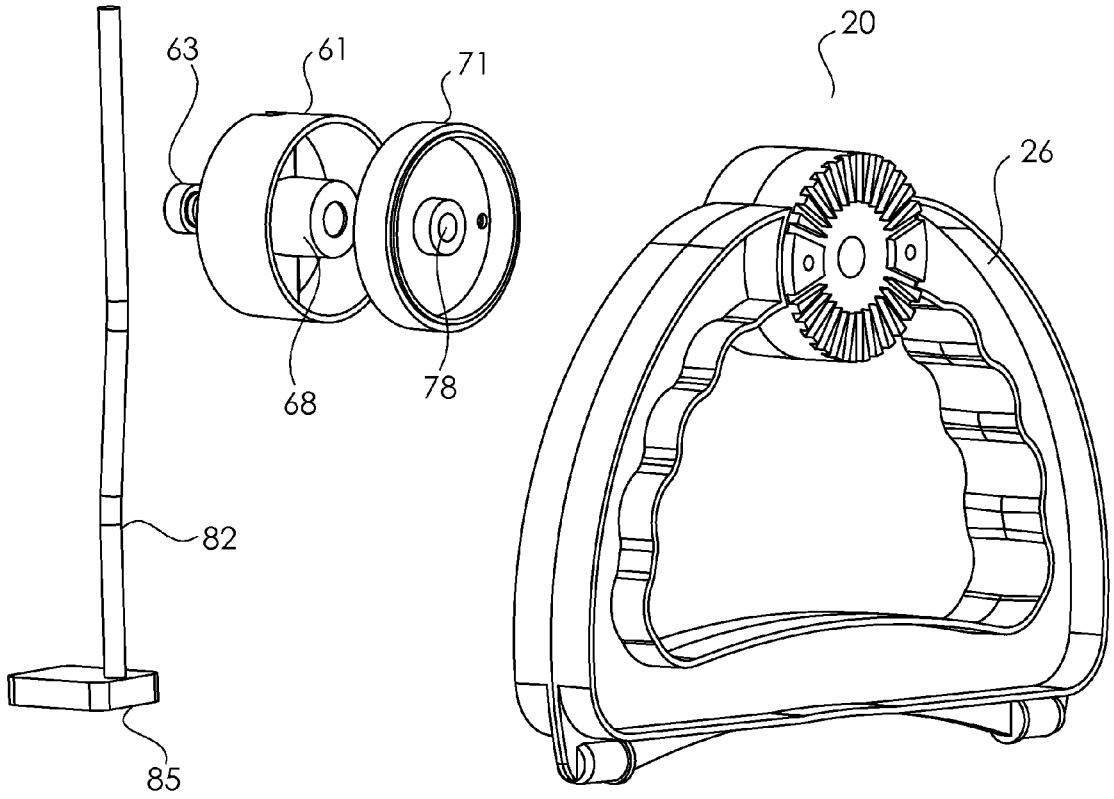
FIG. 9 is another exploded perspective diagram illustrating the exemplary coupler of FIG. 7.

As shown in the illustration of FIGS. 8-9, in some implementations, and without limitation, cap 71 can be fixedly engaged with base 20 and second coupler 61 can be rotatably engaged with cap 71. In some implementations, the cap can be secured to the base through screws (not shown) inserted through holes 75 in cap 71 and holes 77 on base body 26. However, it is to be appreciated that the cap can be secured to the base via a snap-fit connection, a screw-on connection, or via other types of connections. In some further implementations, and without limitation, second coupler 61 can be rotatably engaged with cap 71 via a shoulder screw 63 inserted through hole 68 of second coupler 61 and secured in and through hole 78 of cap 71.

In some advantageous embodiments, the apparatus can include a second elongate rod that is engaged with the second coupler. In some implementations, the second elongate rod can be rigid and can include a head on the distal end thereof. For example, and without limitation, elongate rod 82 can include head 85 on a distal end thereof. In some implementations, second elongate rod can be substantially straight. In some other implementations, the second elongate rod can have one or more bends.

In some embodiments, second coupler 61 can include recess 62 for receiving elongate rod 82 therein. In some implementations, recess 62 may be formed in an outer side wall of coupler 62. In some implementations, recess 62 may extend the entire diameter of coupler 61. In some other implementations, recess 62 may extend less than the entire diameter of coupler 61. In some embodiments, the apparatus can include a lock for securing the elongate rod in the coupler recess. In some embodiments, and without limitation, at least one lock 64 can be provided in recess 62 for securing elongate rod 82 therein. In some implementations, lock 64 can comprise a bump on one or more sidewalls of recess 62 providing compressible force. In some other implementations, lock 64 can comprise a spring loaded ball or tab. It is to be appreciated that the second elongate rod can be engaged to the second coupler though other means in accordance with some embodiments of the present invention. For example, and without limitation, the second elongate rod may be screwed into a threaded recess in the second coupler. In other examples, the second elongate rod may be magnetically attached to the coupler. In other examples, the elongate rod may snap into or onto the coupler. In some other examples, the lock can include a clamp assembly similar to clamp assembly 40 as shown in FIG. 2. It is also to be appreciated that, in accordance with some embodiments of the present invention, the recess of the second coupler may extend less than the entire diameter of the second coupler and/or may be formed entirely within the second coupler.

In some preferred embodiments, and referring to the illustrations of the figures generally, base assembly 20 can include base body 26 that is substantially "D-shaped". However, it is to be appreciated that other base body shapes are contemplated in accordance with some embodiments of the present invention. In some embodiments, and without limitation, base assembly 20 may include one or more feet 27. In some implementations, the feet may be fixed to, or unitarily formed with, base body 26. In some other implementations, the feet may be detachable from the base body. For example, and without limitation, feet 27 may be attached to base body 26 via snap-fit connection features 28 and 29. In some implementations, base body 26 can include generally round nubs 29 and feet 27 can include corresponding recesses 28. In preferred embodiments, feet 27 may be angularly positioned relative to base body 26. For example, and without limitation, base body 26 may be positioned perpendicular relative to feet 27 or tilted relative to feet 27. It is to be appreciated that by enabling angular positioning between feet 27 and base body 26, regardless of the altitude of the playing surface upon which feet 27 rest, base body 26 may be put in an upright position. In some embodiments, the angular positions of the feet relative to the base body may be continuous. In some other embodiments, there may be discrete angular positions of the feet relative to the base body. For example, and without limitation, features 28 and/or 29 may have one or more corresponding tabs and/or slots locking the angular position of the feet relative to the base body.

In some embodiments, base body 26 may have ergonomic features 92 which enable a player to comfortably and securely grip the apparatus during use. In some embodiments, storing features 93, which in some examples can take the form of tabs, hooks, and the like, can be included to store elongate rod 82 when not in use. In other embodiments, additional storing features may be included to store elongate rod 62 when not in use.

Figure 10:
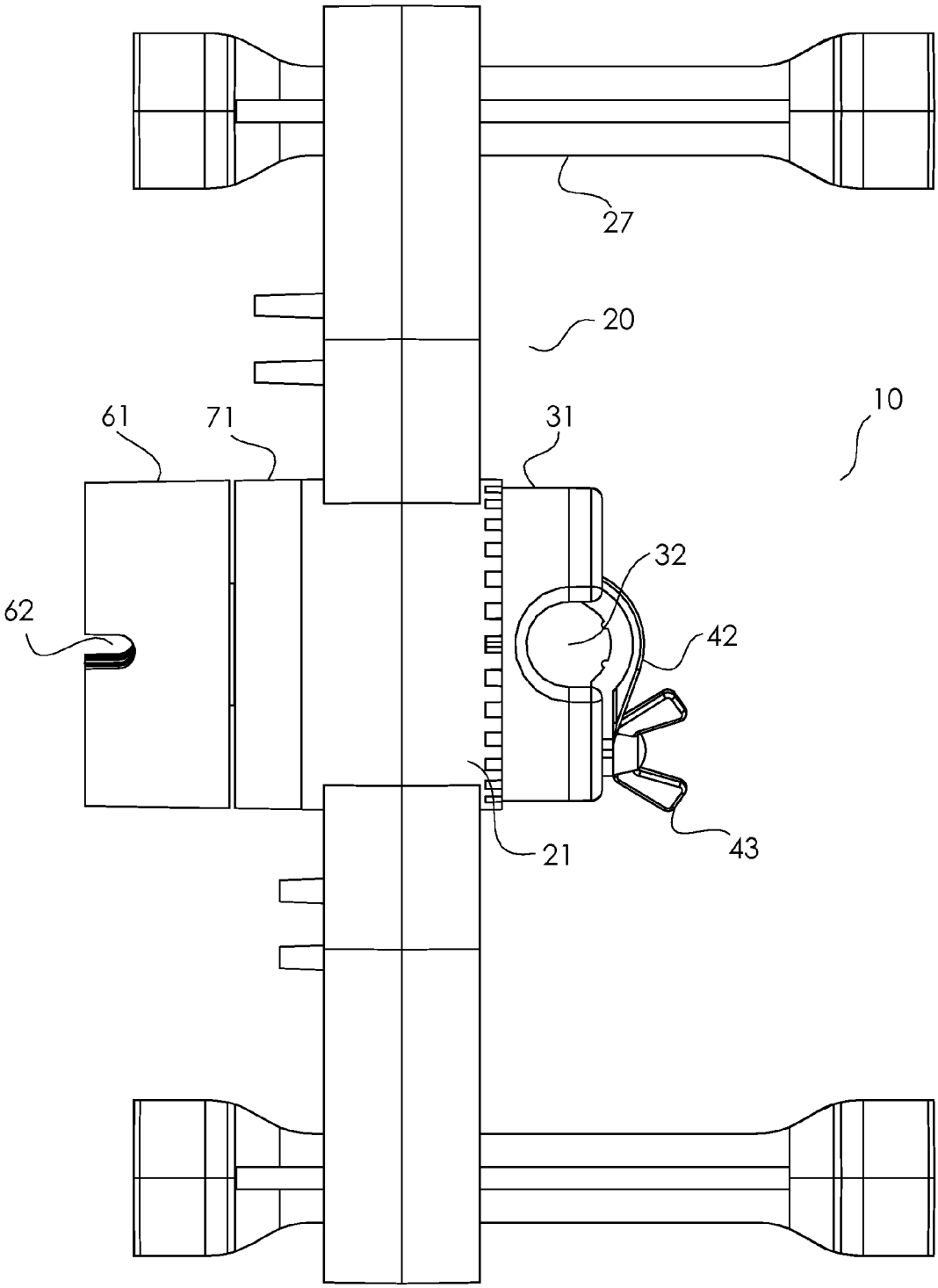
FIG. 10 is a top side view diagram illustrating an exemplary game apparatus in accordance with some embodiments of the present invention.

Referring now to the top side view illustration of FIG. 10, it is to be appreciated that game apparatus 10 can include base assembly 20 supported by one or more feet 27. In some embodiments, coupler 31 can be engaged to index 21 and can include recess 32 for receiving a first elongate rod (not shown) therein. In some embodiments, a clamp assembly (including for example and without limitation plate 42 and screw 43) can secure the first elongate rod in recess 32. In some embodiments, second coupler 61 can be engaged to base assembly 20, and can include recess 62 for receiving a second elongate rod (not shown) therein. In some embodiments, second coupler 61 can be directly with cap 71, and cap 71 can be engaged with base assembly 20.

Exemplary Games

In some advantageous embodiments of the invention, a game system can include a game piece, one or more deformable elongate rods, one or more rigid elongate rods, and/or a playing field. It is to be appreciated that games including interchangeable elongate rods in accordance with some embodiments of the present invention enable parametric adjustability that in turn may enable projectiles to move along different trajectories and/or paths, and allowing for more realistic play and skill development.

In some embodiments, and referring to the drawings generally, a game piece can include base assembly 20, first coupler assembly 30 rotatably engaged to base assembly 20, and second coupler assembly 60 rotatably engaged to base assembly 20. In some embodiments, base assembly 20 can include index 21 with plurality of slots 23. In some embodiments, first coupler assembly 30 can include first coupler 31 having at least one tab 33. In some embodiments, first coupler 31 can be engaged to index 21 of base assembly 20, and tab 33 can be insertable into one of slots 23 of index 21. In some embodiments, first coupler assembly 30 may include recess 32, and second coupler assembly 60 may include recesses 62.

In some embodiments, the game can further include deformable elongate rod 52 insertable into recess 32 of first coupler assembly 30 of the game piece. In some embodiments, deformable elongate rod 52 can include basket 55 on the distal end thereof. In some embodiments, the deformable elongate rod can be a spring, for example and without limitation, an extension spring or a compression spring. However, it is to be appreciated that other deformable elongate rods are contemplated in accordance with some embodiments of the present invention. For example, and without limitation, the deformable elongate rod can be solid and formed of an elastomer or polymer.

In some embodiments, the game can further include at least two deformable elongate rods. In some embodiments, the deformable elongate rods can have different lengths and/or geometries. In some embodiments, they can have different force constants, tensions, Young's modulus, and the like, and/or may be formed of different materials. In some embodiments, baskets on the distal ends of the deformable elongate rods may have different geometries. It is to be appreciated, in accordance with some embodiments of the present invention, games can include any number of deformable elongate rods each having any number of differing characteristics that are interchangeable with the game piece. For example, and without limitation, a first deformable elongate rod may comprise an extension spring and a second deformable elongate rod may comprise a shorter hollow rod formed of rubber, and each rod may have different basket geometries.

In some embodiments, the game can further include rigid elongate rod 82 insertable into recess 62 of second coupler assembly 60. In some embodiments, rigid elongate rod 82 can include head 85 on the distal end thereof. In some embodiments, the game can further include at least two rigid elongate rods. In some embodiments, the rigid elongate rods can have different lengths and/or geometries. In some embodiments, the rigid elongate rods may be formed of different materials. In some embodiments, the heads of the rigid elongate rods may have different weights and/or geometries. For example, and without limitation, a first rigid elongate rod may comprise a 100 gram head with a 90 degree lateral face and the second rigid elongate rod may comprise a 150 gram head with a 75 degree lateral face.

In some embodiments, and although not illustrated, the game can include a playing field that has features which are analogous to their conventional counterparts. For example, and without limitation, a golf game in accordance with some embodiments of the present invention may include a target hole, a target hole flag, synthetic turf, hills, sand trap features, water features, and the like. In some embodiments, base assembly 20 may include one or more feet 27 vertically orienting the game piece relative to a playing surface (such as the playing field). In some embodiments, the angle of the feet relative to the base assembly may be adjusted such that when the feet are placed on the playing surface, the base assembly can maintain a substantially upright position.

Exemplary Methods of Playing Games

Figure 4:
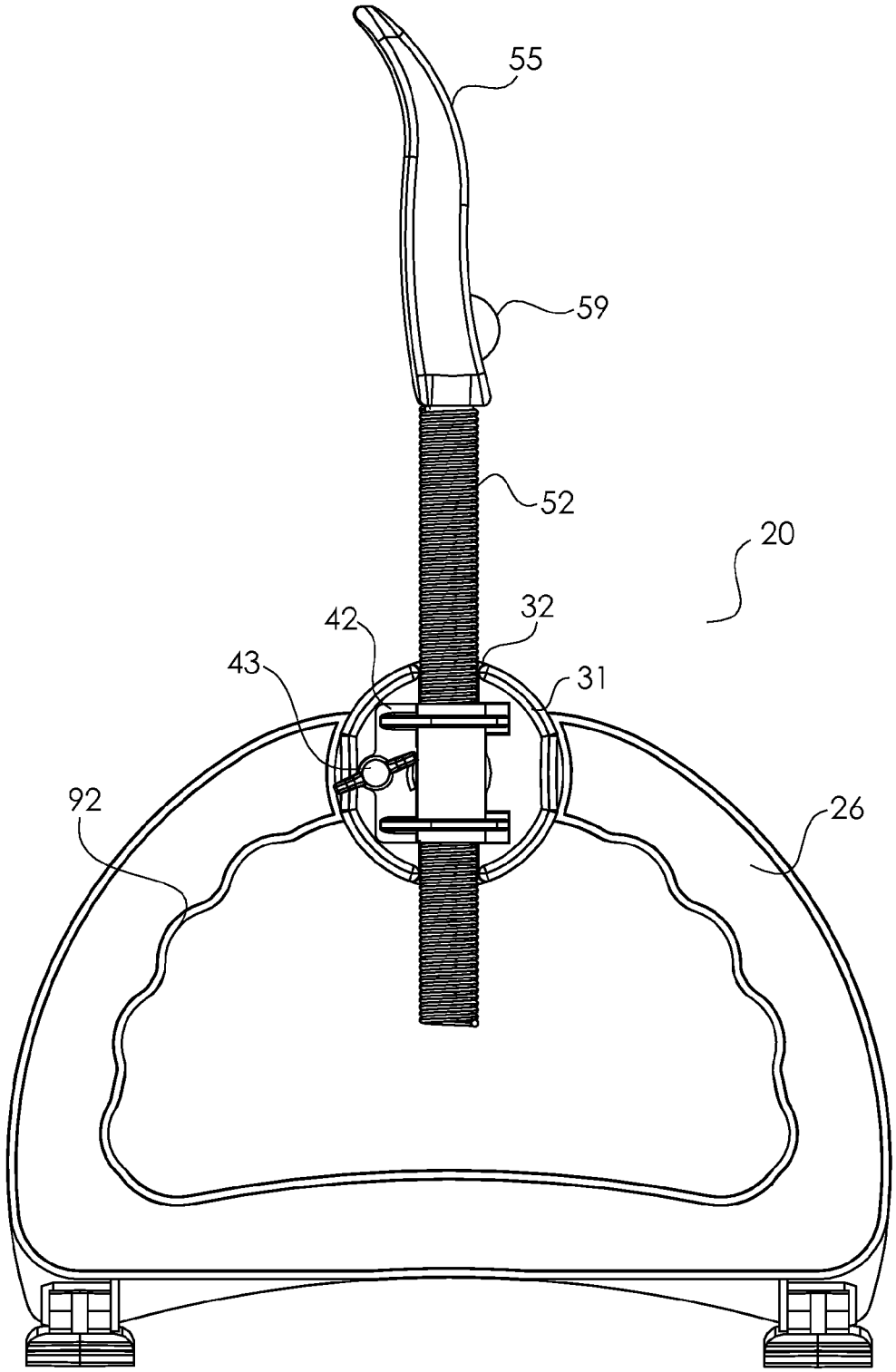
FIG. 4 is a side view diagram illustrating an exemplary coupler in accordance with some embodiments of the present invention.
Figure 5:
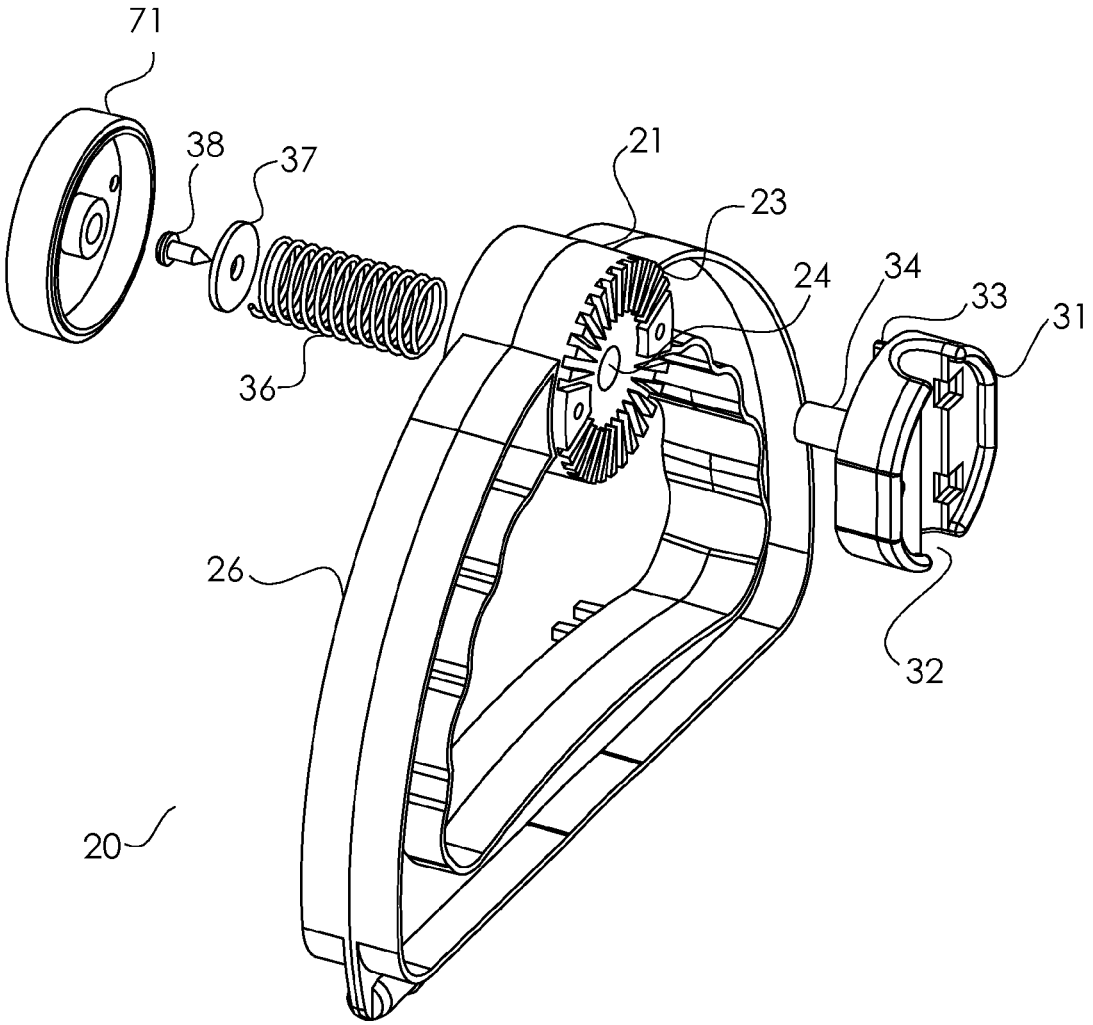
FIG. 5 is an exploded perspective diagram illustrating the exemplary coupler of FIG. 4.

As discussed herein, and with general reference to FIG. 4, in some aspects the present invention concerns a game that can include a projectile and a game piece having a base with an index, a coupler rotatably engaged to the index, and at least one deformable elongate rod with a basket on a distal end thereof. In some other aspects, the present invention concerns a method of playing such game.

In some embodiments, where it is desired to aerially project the projectile (for example, to "drive"), the method can include the step of engaging the deformable elongate rod to the coupler. For example, and without limitation, the deformable elongate rod can be inserted into a recess in the coupler. In some further embodiments, a locking means (such as, for example and without limitation, a clamp) can further be secured so as to prevent removal of the deformable elongate rod.

In some embodiments, the method can include the step of rotating the coupler to a first position relative to the index. For example, and without limitation, the coupler can be rotated such that that the deformable elongate rod is forty five degrees from a vertical position. It is to be appreciated that the angular offset of the coupler relative to the index affects the exit path trajectory of the projectile.

In some embodiments, the method can include the step of placing the projectile in the basket. In some embodiments, the method can include the step of deforming the elongate rod. For example, and without limitation, a user can place his or her finger(s) on the top most portion of the basket while gripping the base of the game piece and impart a downward force sufficient to bend the elongate rod. In some embodiments, the method can include the step of releasing the load to discharge the projectile from the basket. For example, and without limitation, after bending the top most portion of the basket downward, the user can release their finger(s) from the basket. It is to be appreciated that after the load is removed, the deformable elongate rod returns to its static state imparting kinetic energy on the projectile in the basket to discharge it therefrom.

As discussed herein, some aspects the present invention concerns a game having a plurality of deformable elongate rods. In some embodiments, the method of playing the game can include the steps of disengaging a first deformable elongate rod from the coupler and engaging a second deformable elongate rod to the coupler. For example, and without limitation, when a user desires to affect the trajectory of the projectile, they can interchange deformable elongate rods having different characteristics (such as, for example and without limitation, length, Young's modulus, basket geometries).

As discussed herein, some aspects the present invention concerns a game having a game piece comprising a second coupler rotatably engaged to the base and at least one rigid elongate rod with a head on a distal end thereof. In some embodiments, where it is desired to move the projectile along the playing surface (for example, to "putt"), the method of playing the game can include the step of engaging the rigid elongate rod to the second coupler. For example, and without limitation, the rigid elongate rod can be inserted into a recess in the coupler. In some further embodiments, a locking means (such as, for example and without limitation, a hinged tab) can further be secured so as to prevent removal of the rigid elongate rod.

In some embodiments, the method can include the steps placing or moving the game piece near the projectile. In some embodiments, the method of playing the game can include the steps of angularly displacing the rigid elongate rod relative to the base. For example, and without limitation, the rigid elongate rod can be pulled by finger(s) of a user such that the head of the rigid elongate rod is pulled away from the projectile resting on the playing surface. In some embodiments, the method can include the step of releasing the rigid elongate rod to cause the rigid elongate rod to impart a force on the projectile. For example, and without limitation, after pulling the rigid elongate rod away from the projectile, the user can release his or her finger(s) from the rigid elongate rod. It is to be appreciated that after the rigid elongate rod is released, gravitational forces cause the head and the rigid elongate rod to swing downwardly, and when the head contacts the adjacent projectile, kinetic energy is imparted on the projectile.

As discussed herein, some aspects the present invention concerns a game having a plurality of rigid elongate rods. In some embodiments, the method of playing the game can include the steps of disengaging a first rigid elongate rod from the coupler and engaging a second rigid elongate rod to the coupler. For example, and without limitation, when a user desires to affect the path of the projectile, they can interchange rigid elongate rods having different characteristics (such as, for example and without limitation, length, geometries, head weight, and head geometries).

The present invention thusly provides recreational entertainment that most closely parallels mechanics, skill development, and gamesmanship of their counterpart conventional games, do not suffer from the drawbacks of conventional games, and which enable entertainment that varies each time played. It is to be understood that variations, modifications, and permutations of embodiments of the present invention may be made without departing from the scope thereof. It is also to be understood that the present invention is not to be limited by the specific embodiments, descriptions, or illustrations or combinations of either components or steps disclosed herein. Thus, although reference has been made to the accompanying figures, it is to be appreciated that these figures are exemplary and are not meant to limit the scope of the present invention.

What is claimed is:

1. A game apparatus comprising:

a) a base comprising an index with a central bore and a plurality of slots around said bore;

b) a coupler comprising an protrusion and at least one tab around said protrusion, wherein said coupler is rotatably engaged with said index by a spring detent;

c) a deformable elongate rod engaged with said coupler; and d) a basket on a distal end of said elongate rod.

2. The apparatus of claim 1, wherein said index bore axially receives at least a portion of said coupler protrusion.

3. The apparatus of claim 1, wherein said plurality of slots of said index are on a side face of said index and said at least one tab of said coupler is on a side face of said coupler.

4. The apparatus of claim 1, wherein said plurality of slots of said index are on an inner surface of said index bore and said at least one tab of said coupler is on an outer lateral surface of said coupler protrusion.

5. The apparatus of claim 1, said coupler comprising a recess receiving said elongate rod.

6. The apparatus of claim 5, further comprising a clamp securing said elongate rod in said coupler recess.

7. The apparatus of claim 6, said clamp comprising at least one of the group consisting of a plate, a nut, a screw, and combinations thereof.

8. The apparatus of claim 1, said spring detent comprising a compression spring and a compression plate.

9. The apparatus of claim 8, wherein said compression plate is engaged to a distal end of said coupler protrusion.

10. The apparatus of claim 9, wherein said compression spring is in compression between said compression plate and an inner lip of said index bore.

11. The apparatus of claim 8, wherein said compression spring circumscribes at least a portion of said coupler protrusion.

12. The apparatus of claim 1, wherein said elongate rod is a spring.

13. The apparatus of claim 12, wherein said spring is an extension spring.

14. The apparatus of claim 12, wherein said spring is a compression spring.

15. The apparatus of claim 1, further comprising:

a) a second coupler rotatably engaged with said base;

b) a rigid second elongate rod engaged with said second coupler; and c) a head on a distal end of said second elongate rod.

16. The apparatus of claim 15, further comprising a cap and a shoulder screw, wherein said cap is engaged with said base, and wherein said cap is rotatably engaged with said second coupler by said shoulder screw.

17. The apparatus of claim 15, said second coupler comprising a recess receiving said second elongate rod.

18. The apparatus of claim 17, said second coupler recess comprising at least one lock securing said second elongate rod in said second coupler recess.

19. The apparatus of claim 1, further comprising at least one foot hingedly engaged with said base.

20. The apparatus of claim 19, wherein said foot is engaged with said base by a snap-fit connection.

21. A game comprising a game piece, said game piece comprising:

a) a base having an index with a plurality of slots;

b) a first coupler having a recess and at least one tab and rotatably engaged with said index, said at least one tab insertable into one of said plurality of slots of said index; and c) a second coupler having a recess and rotatably engaged to said base.

22. The game of claim 21, further comprising at least one deformable elongate rod insertable in said first coupler recess.

23. The game of claim 22, wherein said deformable elongate rod comprises one of the group consisting of an extension spring and a compression spring.

24. The game of claim 22, further comprising a basket on a distal end of said deformable elongate rod.

25. The game of claim 24, further comprising two deformable elongate rods, wherein a first and a second deformable elongate rod have one of the group consisting of different lengths, different geometries, different force constants, different tensions, different Young's modulus, different materials, different basket geometries, and combinations thereof.

26. The game of claim 21, further comprising at least one rigid elongate rod insertable in said second coupler recess.

27. The game of claim 26, further comprising a head on a distal end of said rigid elongate rod.

28. The game of claim 27, further comprising two rigid elongate rods, wherein a first and a second rigid elongate rod have one of the group consisting of different lengths, different geometries, different weights of said heads, different geometries of said heads, and combinations thereof.

29. An apparatus comprising:

a) a base;

b) a coupler rotatably engaged with said base;

c) a basket; and d) an at least partially deformable elongate rod engaging said basket and said coupler.

30. The apparatus of claim 29, said coupler comprising at least one tab and said base comprising an index having a plurality of slots, wherein said at least one tab of said coupler is insertable into at least one of said plurality of slots of said index.

31. The apparatus of claim 30, further comprising:

a) a second coupler rotatably engaged with said base;

b) a head; and c) a substantially rigid elongate rod coupling said head and said second coupler.

* * * * *